US010566107B2

(12) United States Patent
Kohori et al.

(10) Patent No.: US 10,566,107 B2
(45) Date of Patent: Feb. 18, 2020

(54) COATED ELECTRIC WIRE AND MULTI-CORE CABLE FOR VEHICLE

(71) Applicant: SUMITOMO ELECTRIC INDUSTRIES, LTD., Osaka-shi, Osaka (JP)

(72) Inventors: Takaya Kohori, Kanuma (JP); Hiroyuki Okawa, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 294 days.

(21) Appl. No.: 15/625,331

(22) Filed: Jun. 16, 2017

(65) Prior Publication Data

US 2018/0005723 A1 Jan. 4, 2018

(30) Foreign Application Priority Data

Jun. 24, 2016 (JP) ..... 2016-125787

(51) Int. Cl.
*H01B 3/30* (2006.01)

(52) U.S. Cl.
CPC ..... *H01B 3/30* (2013.01)

(58) Field of Classification Search
CPC ..... B60R 16/0207; B60R 16/023; H01B 3/30
See application file for complete search history.

(56) References Cited

U.S. PATENT DOCUMENTS 4,689,444 A * 8/1987 Burgess ..... H01B 5/08 174/128.1
6,479,590 B1 * 11/2002 Ikeda ..... C08F 255/00 174/119 C
2014/0326480 A1 * 11/2014 Hashimoto ..... H01B 7/295 174/113 R

FOREIGN PATENT DOCUMENTS

CA 2323254 A1 * 5/2001 ..... H01B 7/28
JP 2014-220043 A 11/2014

* cited by examiner

*Primary Examiner* — Hoa C Nguyen
*Assistant Examiner* — Amol H Patel
(74) *Attorney, Agent, or Firm* — Drinker Biddle & Reath LLP

(57) ABSTRACT

A coated electric wire includes a resin insulating layer configured to cover a conductor, the insulating layer covers the conductor with a thickness of 0.3 mm to 0.4 mm, a cross-sectional area of the conductor is 1.5 $mm^2$ to 3.0 $mm^2$, the conductor is configured by stranding a plurality of stranded wires, each of the stranded wires is configured by stranding a plurality of wires, and a diameter of the wires constituting the stranded wire arranged at a center of the conductor is greater than a diameter of the wires constituting the other stranded wires.

10 Claims, 2 Drawing Sheets

COATED ELECTRIC WIRE AND MULTI-CORE CABLE FOR VEHICLE

CROSS-REFERENCE TO RELATED APPLICATION

The present application claims priority from Japanese Patent Application No. 2016-125787 filed on Jun. 24, 2016 the entire content of which is incorporated herein by reference.

BACKGROUND

Technical Field

The present invention relates to a coated electric wire and a multi-core cable for vehicle.

Related Art

Patent Document 1 discloses a multi-core cable. A conductor of a core electric wire of the multi-core cable is a stranded wire formed by stranding a plurality of wires having a diameter of 0.08 mm and made of copper alloy. The number of the wires constituting the conductor is about 360 to 610. A cross-sectional area of the conductor (a total cross-sectional area of the plurality of wires) is 1.5 to 3.0 $mm^2$, preferably 1.8 to 2.5 $mm^2$.

[Patent Document 1] Japanese Patent Application Publication No. 2014-220043A

SUMMARY

The present invention provides a coated electric wire capable of suppressing a bending resistance from being lowered and saving the cost, and a multi-core cable for vehicle using the coated electric wire.

A coated electric wire according to the present invention, comprises:

- a conductor; and
- a resin insulating layer configured to cover the conductor,
- wherein the insulating layer covers the conductor with a thickness of 0.3 mm to 0.4 mm,
- wherein a cross-sectional area of the conductor is 1.5 $mm^2$ to 3.0 $mm^2$,
- wherein the conductor is configured by stranding a plurality of stranded wires,
- wherein each of the stranded wires is configured by stranding a plurality of wires, and
- wherein a diameter of the wires constituting the stranded wire arranged at a center of the conductor is greater than a diameter of the wires constituting the other stranded wires.

A multi-core cable for vehicle, according to the present invention, comprises:

- the two coated electric wires; and
- a sheath configured to cover the two coated electric wires.

According to the present invention, it is possible to provide the coated electric wire capable of suppressing a bending resistance from being lowered and saving the cost, and the multi-core cable for vehicle using the coated electric wire.

DETAILED DESCRIPTION

Figure 1:
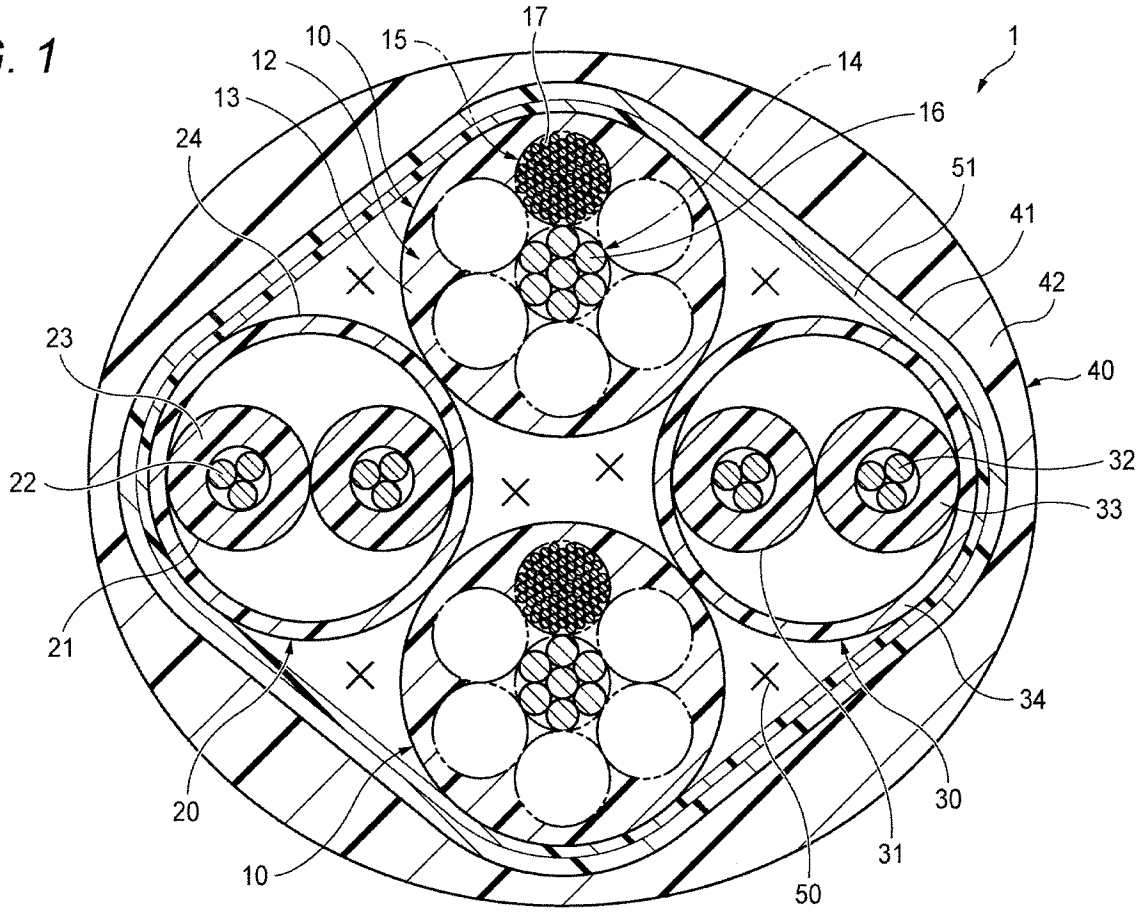
FIG. 1 is a sectional view depicting a multi-core cable for vehicle in accordance with a first exemplary embodiment of the present invention.

Outline of Exemplary Embodiment of Present Invention

First, an outline of an exemplary embodiment of the present invention is described.

(1) A coated electric wire comprises:

- a conductor; and
- a resin insulating layer configured to cover the conductor,
- wherein the insulating layer covers the conductor with a thickness of 0.3 mm to 0.4 mm,
- wherein a cross-sectional area of the conductor is 1.5 $mm^2$ to 3.0 $mm^2$,
- wherein the conductor is configured by stranding a plurality of stranded wires,
- wherein each of the stranded wires is configured by stranding a plurality of wires, and
- wherein a diameter of the wires constituting the stranded wire arranged at a center of the conductor is greater than a diameter of the wires constituting the other stranded wires.

When manufacturing a stranded wire having a desired cross-sectional area, in case that the stranded wire consists of thick wires, the number of wires to be stranded is reduced, as compared to a stranded wire consisting of thin wires, so that it is possible to save the cost. However, in case that the stranded wire consists of the thick wires, a bending resistance of the stranded wire is lowered, as compared to the stranded wire consisting of the thin wires.

Therefore, according to the coated electric wire having the above configuration, the wires thicker than the other wires are used only for the wires constituting the stranded wire to be arranged at the center. Thereby, as compared to a conductor consisting of only the thin wires, it is possible to save the cost of the conductor.

The thick wires are used for some of the wires constituting the conductor, so that there will be a concern about the lowering of the bending resistance of the entire conductor. However, the stranded wire consisting of the thick wires is arranged at the center of the conductor, so that the lowering of the bending resistance of the entire conductor is suppressed. Thereby, it is possible to save the cost while suppressing the lowering of the bending resistance of the entire conductor.

(2) In the coated electric wire of (1), the conductor may be configured by stranding the seven stranded wires, and

- the six stranded wires may be stranded around one stranded wire arranged at the center of the conductor.

According to the coated electric wire having the above configuration, it is possible to arrange the stranded wires in a balanced manner on the section of the coated electric wire, so that it is possible to stably maintain a stranding structure of the conductor.

(3) In the coated electric wire of (2), the diameter of the wire constituting one stranded wire arranged at the center of the conductor may be equal to or greater than 0.1 mm, and the diameter of the wires constituting the other stranded wires may be equal to or smaller than 0.08 mm.

According to the coated electric wire having the above configuration, it is possible to easily implement both the suppression of the lowering of the bending resistance and the cost saving. In case that the diameter of the wire constituting the one stranded wire arranged at the center of the conductor is smaller than 0.1 mm, it is difficult to save the cost. In case that the diameter of the wire constituting the other stranded wire is greater than 0.08 mm, it is difficult to suppress the lowering of the bending resistance.

(4) In the coated electric wire of any of (1) to (3), the insulating layer may have a copolymer of ethylene and α-olefin having a carbonyl group, as a main component.

According to the coated electric wire having the above configuration, the bending resistance of the insulating layer is high and the bending resistance of the coated electric wire is higher.

(5) In the coated electric wire of any of (1) to (4), an outer diameter of the stranded wire having the greatest outer diameter may be 1.5 times or less of an outer diameter of the stranded wire having the smallest outer diameter.

According to the coated electric wire having the above configuration, since the outer diameters of the plurality of stranded wires are even, a stranding shape resulting from the stranding is stable.

(6) In the coated electric wire of any of (1) to (5), the outer diameter of the stranded wire arranged at the center of the conductor may be 75% to 125% of the outer diameter of the other stranded wires.

According to the coated electric wire having the above configuration, since the outer diameters of the plurality of stranded wires are even, a stranding shape resulting from the stranding is stable.

(7) A multi-core cable for vehicle comprises:

the two coated electric wires according to any of (1) to (6); and a sheath configured to cover the two coated electric wires.

According to the multi-core cable for vehicle having the above configuration, it is possible to easily perform a wiring operation, as compared to a case where the two coated electric wires are individually wired.

(8) The multi-core cable for vehicle of (7), may further comprise:

a plurality of second electric wires each of which has a second conductor thinner than the conductor and a second insulating layer configured to cover the second conductor, wherein a pair of the two second electric wires is twisted and configures a twisted pair of the second electric wires.

According to the multi-core cable for vehicle having the above configuration, it is possible to easily perform a wiring operation, as compared to a case where the two coated electric wires and the twisted pair of the second electric wires are individually wired.

(9) In the multi-core cable for vehicle of (8), the two coated electric wires and the twisted pair of the second electric wires may be stranded, and the sheath may cover stranded the two coated electric wires and the twisted pair of the second electric wires.

According to the multi-core cable for vehicle having the above configuration, since the two coated electric wires and the twisted pair of the second electric wires are stranded and the stranded state is covered by the sheath, an outer diameter shape of the multi-core cable is stable.

(10) In the multi-core cable for vehicle of (9), the two coated electric wires may be point-symmetrically arranged on a section perpendicular to a longitudinal direction of the multi-core cable.

According to the multi-core cable for vehicle having the above configuration, the thick coated electric wires are arranged in a balanced manner on a section and the symmetry is thus improved. Therefore, the multi-core cable has less twisting tendency.

(11) In the multi-core cable for vehicle of (7), a ratio (long axis length divided by short axis length) of a long axis length and a short axis length may be 1.8 or greater.

According to the multi-core cable for vehicle having the above configuration, it is possible to favorably wire the multi-core cable in a flat space. The multi-core cable can be easily bent in a short axis direction (thickness direction), so that it can be easily wired. It is possible to easily have a large contact area between the multi-core cable and a target having a surface shape such as a wall, to which the multi-core cable is to be fixed, so that it is possible to easily fix the multi-core cable.

Details of Exemplary Embodiment of Present Invention

Hereinafter, examples of an exemplary embodiment of a coated electric wire and a multi-core cable for vehicle including the coated electric wire of the present invention will be described in detail with reference to the drawings.

First Exemplary Embodiment

A multi-core cable 1 is used so as to connect an ECU (Electric Control Unit) mounted on a vehicle to an electric parking brake, a wheel speed sensor and the like provided around wheels. The wheel is assembled to a vehicle body so as to be rotatable around an axle. Also, the wheel may be assemble via a suspension device or a steering device. That is, the wheel is assembled to the vehicle body so as to be displaceable. The multi-core cable 1 of the first exemplary embodiment is favorably used so as to connect the ECU fixed to the vehicle body and a component that is to be mounted to the wheel assembled to the vehicle body so as to be displaceable. The multi-core cable 1 is required to be arranged in a small space in a tire house, in which the wheel is to be accommodated, to be easily bent so as not to disturb displacement of the tire and to have high durability against the bending to be repeatedly applied thereto.

FIG. 1 is a sectional view depicting the multi-core cable 1 in accordance with the first exemplary embodiment of the present invention. FIG. 1 depicts a section perpendicular to a longitudinal direction of the multi-core cable 1. As shown in FIG. 1, the multi-core cable 1 includes two power wires 10, two signal wires 21, two electric wires 31 and a sheath 40. An outer diameter of the multi-core cable 1 of the first exemplary embodiment can be set to be in a range of 7 mm to 18 mm, preferably a range of 7.5 mm to 13 mm.

(Power Wire)

The two power wires 10 (an example of the coated electric wire) include, respectively, a first conductor 12 (an example of the conductor) and a first insulating layer 13 (an example of the insulating layer) configured to cover the first conductor 12. The two power wires 10 have the same size and are made of the same material.

The two power wires 10 can be used to connect the electric parking brake and the ECU. The electric parking brake has a motor configured to drive a brake caliper. For example, one power wire 10 can be used as a power feeding wire configured to feed power to the motor and the other power wire 10 can be used as an earth wire of the motor.

The first conductor 12 is configured by standing a plurality of stranded wires. Each stranded wire is configured by stranding a plurality of wires. The wire is a wire made of copper or copper alloy. The wire may also be made of a material having predetermined conductivity and flexibility such as tin-plated annealed copper wire, in addition to copper and copper alloy. A cross-sectional area of the first conductor 12 may be set to be in a range of 1.5 $mm^2$ to 3 $mm^2$.

In the shown example, the first conductor 12 is configured by stranding the seven stranded wires. On a section perpendicular to a longitudinal direction of the power wire 10, one stranded wire (hereinafter, referred to as 'central stranded wire 14') is positioned at a radial center and the six stranded wires (hereinafter, referred to as 'surrounding stranded wire 15') are positioned to surround the central stranded wire 14. A positional relation that the central stranded wire 14 is always positioned at the radial center and the surrounding stranded wire 15 are always positioned around the central stranded wire 14 is kept in a longitudinal direction of the multi-core cable 1.

The central stranded wire 14 is configured by stranding 46 wires 16 having a diameter of 0.1 mm. An outer diameter of the central stranded wire 14 is 0.8 mm. The surrounding stranded wire 15 is configured by stranding 72 wires 17 having a diameter of 0.08 mm. An outer diameter of the surrounding stranded wire 15 is 0.8 mm. The wire 16 of the central stranded wire 14 is thicker than the wire 17 of the surrounding stranded wire 15. Meanwhile, in FIG. 1, the number of the wires 16 of the central stranded wire 14 is shown to be different from the actual number thereof so as to easily perceive that the number of the wires 16 of the central stranded wire 14 is smaller than the wire 17 of the surrounding stranded wire 15.

Preferably, a diameter of the wire 16 of the central stranded wire 14 is equal to or greater than 0.1 mm and a diameter of the wire 17 of the surrounding stranded wire 15 is equal to or smaller than 0.08 mm. In case that the diameter of the wire 16 of the central stranded wire 14 is smaller than 0.1 mm, it is difficult to save the cost. In case that the diameter of the wire 17 of the surrounding stranded wire 15 is greater than 0.08 mm, it is difficult to suppress the lowering of the bending resistance. The diameter of the wire 16 of the central stranded wire 14 and the diameter of the wire 17 of the surrounding stranded wire 15 are preferably set to be in a range of 0.05 mm to 0.2 mm.

Also, in the first exemplary embodiment, the outer diameter of the surrounding stranded wire 15 is 0.98 times of the outer diameter of the central stranded wire 14. That is, the outer diameter of the surrounding stranded wire 15, which has the largest outer diameter, of the stranded wires is 1.5 times or less of the outer diameter of the central stranded wire, which has the smallest outer diameter, of the stranded wires. Also, the outer diameter of the central stranded wire 14 is 101% of the outer diameter of the surrounding stranded wire 15. That is, the outer diameter of the central stranded wire 14 arranged at the center of the first conductor 12 is 75% to 125% of the outer diameter of the other surrounding stranded wires 15. Like this, in the first exemplary embodiment, since the sizes of the plurality of stranded wires 14, 15 are even, a stranding shape of the first conductor 12 configured by stranding the plurality of stranded wires 14, 15 is likely to be stable.

An outer diameter of the first insulating layer 13 can be set to be in a range of 2 mm to 4 mm. A thickness of the thinnest portion of the first insulating layer 13 (a thickness from a surface of the stranded wire to an outer surface of the first insulating layer 13) is set to be in a range of 0.3 mm to 0.4 mm. The first insulating layer 13 is preferably formed of a resin having, as a main component, copolymer of ethylene and α-olefin having a carbonyl group but may also be formed of a resin such as crosslinked heat-resistant polyethylene or crosslinked fluorine-based resin.

From a standpoint of improving the bending resistance at a lower operation temperature, the first insulating layer 13 is preferably formed copolymer of ethylene and α-olefin having a carbonyl group (hereinafter, referred to as 'main component resin'). A lower limit of a content of α-olefin having a carbonyl group of the main component resin is preferably 14 mass %, more preferably 20 mass %. On the other hand, an upper limit of the content of α-olefin having a carbonyl group is preferably 46 mass %, more preferably 30 mass %. When the content of α-olefin having a carbonyl group is less than the lower limit, there is a concern that improvement on the bending resistance at low temperatures will be insufficient. To the contrary, when the content of α-olefin having a carbonyl group exceeds the upper limit, there is a concern that the mechanical property of the first insulating layer 13 such as strength will be lowered.

As α-olefin having a carbonyl group, alkyl (meth)acrylate ester such as methyl (meth)acrylate and ethyl (meth)acrylate; (meth)acrylate aryl ester such as phenyl (meth)acrylate; vinyl ester such as vinyl acetate and vinyl propionate; unsaturated acid such as (meth)acrylate, crotonic acid, maleic acid and itaconic acid; vinyl ketone such as methyl vinyl ketone and phenyl vinyl ketone; (meth)acrylic acid amide, and the like can be exemplified. Among of them, alkyl (meth)acrylate ester and vinyl ester are preferable and ethyl acrylate and vinyl acetate are more preferable.

As the main component resin, resins such as EVA, EEA, ethylene-methyl acrylate copolymer (EMA), ethylene-butyl acrylate copolymer (EBA) and the like can be exemplified. Among of them, EVA and EEA are preferable.

In the first exemplary embodiment, the two power wires 10 are point-symmetrically arranged on the section perpendicular to the longitudinal direction of the multi-core cable 1. The thick power wires 10 are arranged in a balanced manner on the section and the symmetry is thus improved. Therefore, the multi-core cable 1 has less twisting tendency. Since one twisted pair 20 of signal wires and one twisted pair 30 of electric wires are also point-symmetrically arranged on the section perpendicular to the longitudinal direction of the multi-core cable 1, the symmetry of the multi-core cable 1 is further improved.

(Signal Wire)

The two signal wires 21 include, respectively, a second conductor 22 thinner than the first conductor 12 and a second insulating layer 23 configured to cover the second conductor 22. The two signal wires 21 to be twisted have the same size and are formed of the same material. A pair of the signal wires 21 is twisted and is configured as a twisted pair 20 of signal wires. A twisting pitch of the twisted pair 20 of signal wires may be set to be in a range of 10 to 15 times of a twisting diameter of the twisted pair 20 of signal wires (an outer diameter of the twisted pair 20 of signal wires). The twisted pair 20 of signal wires is covered with a signal coating 24. The signal coating 24 may be formed of a material, which is the same as or different from the first insulating layer 13.

The outer diameter of the twisted pair 20 of signal wires can be set to be substantially the same as an outer diameter of the power wire 10. The outer diameter of the power wire 10 is preferably 75% to 136% of the outer diameter of the twisted pair 20 of signal wires. The outer diameter of the power wire 10 is more preferably 75% to 125% of the outer diameter of the twisted pair 20 of signal wires. The outer diameter of the power wire 10 is most preferably 90% to 115% of the outer diameter of the twisted pair 20 of signal wires.

The signal wire 21 can be used to transmit a signal from a sensor or to transmit a control signal from the ECU. The two signal wires 21 can be used for wiring of an ABS (Anti-lock Brake System), for example. The two signal wires 21 can be respectively used as a wire for connecting a differential wheel speed sensor and an ECU of a vehicle, for example.

The second conductor 22 may be configured by stranding a plurality of wires, as shown, or may be configured by one wire. The second conductor 22 may be formed of a material, which is the same as or different from the wire constituting the first conductor 12. A cross-sectional area of the second conductor 22 may be set to be in a range of 0.13 $mm^2$ to 0.5 $mm^2$. The second insulating layer 23 may be formed of a material, which is the same as or different from the first insulating layer 13. An outer diameter of the second insulating layer 23 may be set to be in a range of 1.0 mm to 2.2 mm.

(Electric Wire)

The two electric wires 31 include, respectively, a third conductor 32 thinner than the first conductor 12 and a third insulating layer 33 configured to cover the third conductor 32. A pair of the two electric wires 31 is twisted and is configured as a twisted pair 30 of electric wires. The two electric wires 31 to be twisted have the same size and are formed of the same material. The size and material of the electric wire 31 may be the same as those of the signal wire 21. The twisted pair 30 of electric wires is preferably stranded in the same direction as the twisted pair 20 of signal wires. A twisting pitch of the twisted pair 30 of electric wires is preferably the same as the twisted pair 20 of signal wires. The twisted pair 30 of electric wires is covered with an electric wire coating 34. The electric wire coating 34 may be formed of a material, which is the same as or different from the wire constituting the first insulating layer 13.

An outer diameter of the twisted pair 30 of electric wires may be set to be substantially the same as the outer diameter of the twisted pair 20 of signal wires. The outer diameter of the twisted pair 30 of electric wires may be set to be substantially the same as the outer diameter of the power wire 10. The outer diameter of the power wire 10 is preferably 75% to 136% of the outer diameter of the twisted pair 30 of electric wires.

The outer diameter of the power wire 10 is more preferably 75% to 125% of the outer diameter of the twisted pair 30 of electric wires. The outer diameter of the power wire 10 is most preferably 90% to 115% of the outer diameter of the twisted pair 30 of electric wires.

The electric wire 31 can be used to transmit a signal from a sensor and to transmit a control signal from the ECU, and can also be used as a power feeding wire for feeding power to an electronic device. The electric wire 31 can be used as a power feeding wire, a control line and a sensor wire, which are to be used for an active suspension system configured to change a hydraulic characteristic of the suspension. Alternatively, the electric wire 31 can be used for wiring of a CAN (Controller Area Network) for vehicle, for example.

The third conductor 32 may be configured by stranding a plurality of wires, as shown, or may be configured by one wire. The third conductor 32 may be formed of a material, which is the same as or different from the conductor constituting the first conductor 12 or the second conductor 22. A cross-sectional area of the third conductor 32 may be set to be in a range of 0.13 $mm^2$ to 0.5 $mm^2$. The third insulating layer 33 may be formed of a material, which is the same as or different from the second insulating layer 23. An outer diameter of the third insulating layer 33 may be set to be in a range of 1.0 mm to 2.2 mm.

(Sheath)

The sheath 40 is configured to cover all the wires including the two power wires 10, the two signal wires 21 and the two electric wires 31. The two power wires 10, one twisted pair 20 of signal wires and one twisted pair 30 of electric wires are integrally stranded. The sheath 40 is configured to cover the two power wires 10, one twisted pair 20 of signal wires and one twisted pair 30 of electric wires integrally stranded.

The sheath 40 includes an inner sheath 41 and an outer sheath 42 positioned at an outermore side than the inner sheath 41. An outer diameter of the sheath 40 can be set to be in a range of 7.5 mm to 11 mm.

The inner sheath 41 is configured to keep a stranded shape of all the wires including the two power wires 10, the two signal wires 21 and the two electric wires 31. The inner sheath 41 is formed by extruding and coating the same on outer peripheries of the two power wires 10, the two signal wires 21 and the two electric wires 31. The inner sheath 41 may be formed of the same material as the outer sheath 42 or a resin different from the outer sheath 42. The inner sheath 41 may be formed of a polyolefin-based resin such as polyethylene and ethylene-vinyl acetate copolymer (EVA), polyurethane elastomer, polyester elastomer or a resin composition formed by mixing at least two thereof. The inner sheath 41 may be crosslinked.

The outer sheath 42 is provided so as to protect all the wires including the two power wires 10, the two signal wires 21 and the two electric wires 31 from an outside. The outer sheath 42 is formed by extruding and coating the same on an outer periphery of the inner sheath 41. The outer sheath 42 may be formed of crosslinked/non-crosslinked polyurethane (TPU) having excellent abrasion resistance, for example. Due to the excellent heat resistance, the outer sheath 42 is preferably formed of crosslinked polyurethane. For example, the outer sheath 42 may be formed of polyurethane having excellent abrasion resistance, and the inner sheath 41 may be formed of polyethylene or the like cheaper than polyurethane configuring the outer sheath 42 inasmuch as the effect thereof is exhibited.

(Filler)

The multi-core cable 1 includes a filler 50. The filler 50 is provided inside the sheath 40. The filler 50 is provided between the two power wires 10. It is possible to arrange the filler 50 between the two power wires 10 by stranding the two power wires 10, the twisted pair 20 of signal wires and the twisted pair 30 of electric wires together with the filler 50.

The filler 50 may be configured by fiber such as spun rayon yarn and nylon yarn. The filler 50 is preferably configured by fiber having favorable slidability relative to the power wire 10. Since the spun rayon yarn and nylon yarn have a buffer action with respect to displacement of the power wire 10, the filler 50 is preferably configured by the spun rayon yarn or nylon yarn: The filler 50 may be configured by yarn consisting of tensile strength fiber. The filler 50 may be configured by yarn formed of a material, which is the same as or different from the sheath 40. The filler 50 may be configured by yarn formed of polyethylene (PE) or polypropylene (PP).

(Wrapping Tape)

The multi-core cable 1 may have a wrapping tape 51. The wrapping tape 51 is configured to cover the two power wires 10, one twisted pair 20 of signal wires and one twisted pair 30 of electric wires. The wrapping tape 51 is configured to stably keep the stranded shape of the wires. The wrapping tape 51 is provided inside the sheath 40.

As the wrapping tape 51, a paper tape, a non-woven fabric tape, a resin tape such as polyester and the like can be used. Also, the wrapping tape 51 may be spirally wrapped or longitudinally wrapped onto the two power wires 10, one twisted pair 20 of signal wires and one twisted pair 30 of electric wires. Also, the wrapping direction may be a Z wrapping or S wrapping. Also, the wrapping direction may be the same direction as the pair twisting direction of the twisted pair 20 of signal wires and the twisted pair 30 of electric wires or may be an opposite direction thereto. The wrapping direction of the wrapping tape 51 and the pair twisting direction of the twisted pair 20 of signal wires and the twisted pair 30 of electric wires are preferably opposite to each other because the unevenness is difficult to occur on a surface of the wrapping tape 51 and the outer diameter shape of the multi-core cable 1 can be easily stable.

When providing the sheath 40 of resin by the extrusion coating, the resin is attached to the two power wires 10, so that it may be difficult to separate the two power wires 10 at a terminal of the multi-core cable 1. However, the wrapping tape 51 is provided, so that it is possible to prevent the resin from being attached to the two power wires 10 and to easily take out the two power wires 10 from the terminal.

(Shield Layer)

The multi-core cable 1 may have a shield layer for suppressing a noise to be emitted outside. The shield layer may be configured by wrapping a metal tape onto the power wire 10, the twisted pair 20 of signal wires and the twisted pair 30 of electric wires. The shield layer may also be configured by spirally wrapping a plurality of thin metal wires. Alternatively, the shield layer may also be configured by braiding thin metal wires. The shield layer may be provided outside the wrapping tape 51 and inside the sheath 40.

(Effects)

When manufacturing a stranded wire having a desired cross-sectional area, in case that the stranded wire consists of the thick wires, it is possible to save the cost because the number of wires to be stranded is reduced, as compared to a case where the stranded wire consists of the thin wires. However, when the conductor consists of the thick wires, the bending resistance of the conductor is lowered, as compared to a case where the conductor consists of the thin wires.

Therefore, according to the power wire 10 of the first exemplary embodiment, the wires thicker than the other wires 17 are used only for the wires 16 of the central stranded wire 14. Thereby, it is possible to save the cost of the conductor, as compared to a case where the conductor consists of only the thin wires.

The thick wires 16 are used for some of the wires constituting the first conductor 12, so that there will be a concern about the lowering of the bending resistance of the entire first conductor 12. However, the central stranded wire 14 configured by the thick wires 16 is arranged at the center of the first conductor 12, so that the lowering of the bending resistance of the entire first conductor 12 is suppressed. For example, when the power wire 10 is bent, axial compressive stress is applied to an inner portion of the bent portion and axial tensile stress is applied to an outer portion of the bent portion. However, high stress is not applied to a central portion of the bent portion. When the power wire 10 is bent, the surrounding stranded wires 15 are positioned at the inner and outer portions of the bent portion and the central stranded wire 14 is positioned at the central portion of the bent portion. That is, while the surrounding stranded wire 15 highly influences the bending resistance of the power wire 10, the central stranded wire 14 does not exert high influence on the bending resistance, as compared to the surrounding stranded wire 15. Therefore, in the power wire 10 of the first exemplary embodiment, the central stranded wire 14 consisting of the thick wires 16 is arranged at the center of the first conductor 12, so that it is possible to save the cost while suppressing the lowering of the bending resistance.

In the multi-core cable 1 of the first exemplary embodiment, the first conductor 12 is configured by stranding one central stranded wire 14 and the six surrounding stranded wires 15 arranged around the central stranded wire 14. It is possible to arrange the stranded wires 14, 15 in a balanced manner on the section of the power wire 10, so that it is possible to stably keep the stranding structure of the first conductor 12.

In the multi-core cable 1 of the first exemplary embodiment, the outer diameter of the power wire 10 is preferably 75% to 136% of the outer diameter of the twisted pair 20 of signal wires. The outer diameter of the power wire 10 is more preferably 75% to 125% of the outer diameter of the twisted pair 20 of signal wires. The outer diameter of the power wire 10 is most preferably 90% to 115% of the outer diameter of the twisted pair 20 of signal wires. In the meantime, the outer diameter of the power wire 10 means the outer diameter of the first insulating layer 13. The outer diameter of the twisted pair 20 of signal wires means a diameter of a virtual circumscribed circle on which the pair of signal wires 21 is circumscribed. For example, the outer diameter of the twisted pair 20 of signal wires can be measured by interposing the two stranded signal wires 21 in a micrometer.

According to the multi-core cable 1 of the first exemplary embodiment, since the sizes of the two power wires 10 and the twisted pair 20 of signal wires are substantially matched, it is possible to easily keep the stranded shape and to easily even the diameter of the multi-core cable 1 along the longitudinal direction. Also, since the two power wires 10 and the twisted pair 20 of signal wires are arranged with a predetermined positional relation being maintained on the section perpendicular to the longitudinal direction of the multi-core cable 1, a sectional shape after the stranding is a substantially circular shape. For this reason, it is possible to easily form the sectional shape of the sheath 40 into a substantial true circle and a gap is difficult to occur between the sheath 40 and a water stop member, so that a water stopping ability is further improved. Also, the twisted pair 20 of signal wires and the twisted pair 30 of electric wires are preferably substantially matched.

In a multi-core cable having a plurality of wires, the wires rub with each other, so that bending resistance may be lowered. However, according to the multi-core cable 1 of the first exemplary embodiment, when the multi-core cable 1 is bent, the wires 10, 20, 30 slide on the filler 50, so that forces resulting from contact between the power wires 10, contact between the power wires 10 and the twisted pair 20 of signal wires and contact between the power wires 10 and the twisted pair 30 of electric wires are less generated. For this reason, the bending resistance of the multi-core cable 1 is improved.

Second Exemplary Embodiment

Figure 2:
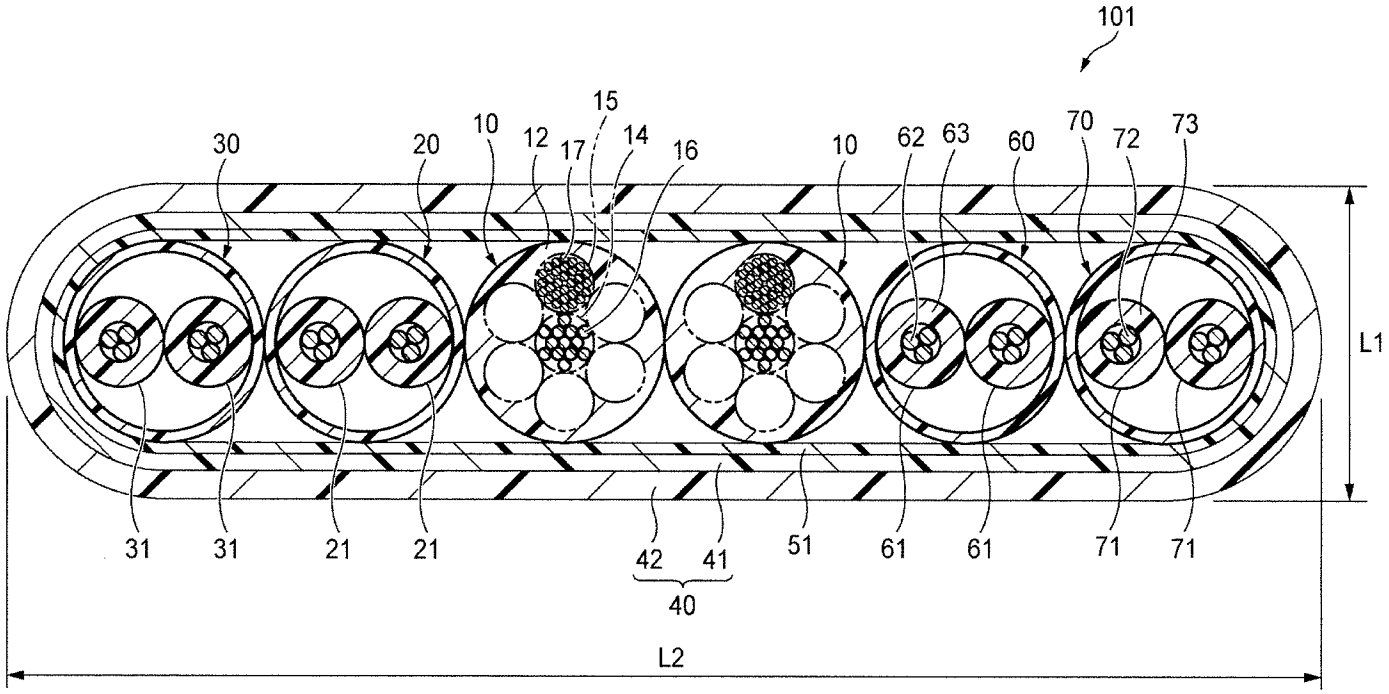
FIG. 2 is a sectional view depicting a multi-core cable for vehicle in accordance with a second exemplary embodiment of the present invention.

In the first exemplary embodiment, the multi-core cable 1 in which the two power wires 10, the two signal wires 21 and the two electric wires 31 are stranded has been described. However, the present invention is not limited thereto. FIG. 2 is a sectional view depicting a multi-core cable 101 for vehicle in accordance with a second exemplary embodiment of the present invention.

The multi-core cable 101 of the second exemplary embodiment includes the two power wires 10, one twisted pair 20 of signal wires having the two signal wires 21, one twisted pair 30 of electric wires having the two electric wires 31, one second paired stranded electric wire 60 having two electric wires 61 and one third paired stranded electric wire 70 having two electric wires 71. The two power wires 10, one twisted pair 20 of signal wires, one twisted pair 30 of electric wires, one second paired stranded electric wire 60 and one third paired stranded electric wire 70 are aligned in one row and covered with the sheath 40. On the section, a ratio (L2/L1) of a length L2 in a long axis direction to a length L1 in a short axis direction is 1.8 or greater. In the shown example, the ratio L2/L1 is 4.6. The ratio L2/L1 can be set to be 7 or less.

The second paired stranded electric wire 60 is configured by stranding a pair of two electric wires 61. Each of the two electric wires 61 includes a fourth conductor 62 thinner than the first conductor 12 and a fourth insulating layer 63 configured to cover the fourth conductor 62. The two electric wires 61 have the same size and are formed of the same material.

The third paired stranded electric wire 70 is configured by stranding a pair of two electric wires 71. Each of the two electric wires 71 includes a fifth conductor 72 thinner than the first conductor 12 and a fifth insulating layer 73 configured to cover the fifth conductor 72. The two electric wires 71 have the same size and are formed of the same material.

The power wire 10 can be used so as to connect the motor of the electric parking brake and the ECU, for example. The twisted pair 20 of signal wires can be used for wiring of the ABS, for example. The twisted pair 30 of electric wires can be used for wiring of a damper control system, for example. The second paired stranded electric wire 60 and the third paired stranded electric wire 70 can be used for wiring of an in-vehicle network, for example.

Also in the second exemplary embodiment, the power wire 10 is configured by stranding one central stranded wire 14 and the six surrounding stranded wires 15 arranged around the central stranded wire. The wire 16 of the central stranded wire 14 is thinner than the wire 17 of the surrounding stranded wire 15. For this reason, it is possible to save the cost while suppressing the lowering of the bending resistance.

In the first exemplary embodiment and the second exemplary embodiment, the first conductor is configured by one central stranded wire and the six surrounding stranded wires. However, the present invention is not limited thereto. That is, the number of the wires constituting the central stranded wire and the number of the wires constituting the surrounding stranded wires are not particularly limited.

In the meantime, the stranding configuration of the first conductor is not particularly limited. However, when the first conductor is configured by one central stranded wire and the six surrounding stranded wires, which has been described in the first exemplary embodiment and the second exemplary embodiment, the stranding structure can be easily stable.

Also, the exemplary embodiments, the coated electric wire of the present invention is applied to the power wires 10, 10A but may also be applied to the signal wire 21, the electric wires 31, 61, 71 and the like. The coated electric wire of the present invention may also be applied to all the electric wires constituting the multi-core cable or may also be applied to some of the electric wires constituting the multi-core cable.

EXAMPLES

As shown in Table 1, power wires of Example 1, Example 2 and Comparative Example 1 were manufactured and the bending resistances thereof were evaluated. All the power wires were configured by stranding one central stranded wire arranged at the center and the six surrounding stranded wires provided around the central stranded wire.

Example 1

A central stranded wire having a diameter of 0.8 mm was manufactured by stranding 46 wires having a diameter of 0.10 mm and made of tin-copper alloy. A surrounding stranded wire having a diameter of 0.8 mm was manufactured by stranding 72 copper alloy wires having a diameter of 0.08 mm. A first conductor was manufactured by stranding the six surrounding stranded wires about one central stranded wire. The first conductor was covered with ethylene-ethyl acrylate copolymer (EEA) having a thickness of 0.3 mm and serving as the first insulating layer, so that a power line of Example 1 was manufactured.

Example 2

A central stranded wire having a diameter of 0.8 mm was manufactured by stranding 46 wires having a diameter of 0.10 mm and made of tin-copper alloy. A surrounding stranded wire having a diameter of 0.8 mm was manufactured by stranding 72 copper alloy wires having a diameter of 0.08 mm. A first conductor was manufactured by stranding the six surrounding stranded wires about one central stranded wire. The first conductor was covered with cross-linked flame-retardant polyethylene having a thickness of 0.3 mm and serving as the first insulating layer, so that a power line of Example 2 was manufactured.

Comparative Example 1

A central stranded wire and a surrounding stranded wire each having a diameter of 0.8 mm were manufactured by stranding 72 wires having a diameter of 0.08 mm and made of tin-copper alloy. A first conductor was manufactured by stranding the six surrounding stranded wires about one central stranded wire. The first conductor was covered with EEA having a thickness of 0.3 mm and serving as the first insulating layer, so that a power line of Comparative Example 1 was manufactured.

TABLE 1

| <Example 1> | | | |
|---|---|---|---|
| central stranded wire | number of stranded wires | | 1 |
| | diameter of stranded wire | | 0.8 mm |
| | wire | diameter of wire | 0.10 mm |
| | | material of wire | tin-copper alloy |
| | | number of wires | 46 |
| surrounding stranded wire | number of stranded wires | | 6 |
| | diameter of stranded wire | | 0.8 mm |
| | wire | diameter of wire | 0.08 mm |
| | | material of wire | tin-copper alloy |
| | | number of wires | 72 |
| insulating | thickness | | 0.3 mm |

TABLE 1-continued

| | | | |
|---|---|---|---|
| layer | | material | EEA |
| | 180° repeated test | | excellent |
| | U-shaped bend test | | excellent |
| <Example 2> | | | |
| central stranded wire | number of stranded wires | | 1 |
| | diameter of stranded wire | | 0.8 mm |
| | wire | diameter of wire | 0.10 mm |
| | | material of wire | tin-copper alloy |
| | | number of wires | 46 |
| surrounding stranded wire | number of stranded wires | | 6 |
| | diameter of stranded wire | | 0.8 mm |
| | wire | diameter of wire | 0.08 mm |
| | | material of wire | tin-copper alloy |
| | | number of wires | 72 |
| insulating layer | | thickness | 0.3 mm |
| | | material | crosslinked flame-retardant polyethylene |
| | 180° repeated test | | acceptable |
| | U-shaped bend test | | acceptable |
| <Comparative Example 1> | | | |
| central stranded wire | number of stranded wires | | 1 |
| | diameter of stranded wire | | 0.8 mm |
| | wire | diameter of wire | 0.08 mm |
| | | material of wire | tin-copper alloy |
| | | number of wires | 72 |
| surrounding stranded wire | number of stranded wires | | 6 |
| | diameter of stranded wire | | 0.8 mm |
| | wire | diameter of wire | 0.08 mm |
| | | material of wire | tin-copper alloy |
| | | number of wires | 72 |
| insulating layer | | thickness | 0.3 mm |
| | | material | EEA |
| | 180° repeated test | | unacceptable |
| | U-shaped bend test | | unacceptable |

(Repeated Bend Test)

The bending resistance of the power wire was evaluated in accordance with the repeated bend test prescribed in ISO 14572:2011(E). In the repeated bend test, the power wire was repeatedly applied with bending of −90° to +90°. When a reduction amount in electric resistance value of the power wire from an initial electric resistance value after the bending of 100,000 times was 5% or greater, it was determined that the power wire was broken. When the reduction amount in electric resistance value of the power wire from the initial electric resistance value was smaller than 5%, the power wire was determined as acceptable. Also, when the reduction amount in electric resistance value of the power wire from the initial electric resistance value after the bending of 150,000 times was smaller than 5%, the power wire was determined as excellent.

The power wires of Examples 1 and 2 were acceptable. In particular, the power wire of Example 1 was excellent. However, the power wire of Comparative Example 1 was unacceptable.

(U-Shaped Bend Test)

The evaluation was performed in accordance with an automobile standard JASO C467-977.16 sensor harness bend test set by a public interest incorporated association, Society of Automotive Engineers of Japan, Inc. In this test, the power wire was repeatedly applied with the bending from a linear shape to a U shape. After performing the bending 300,000 times at −30° C., the bending was continuously performed 700,000 times at room temperature. After the test, when there was no external abnormality such as breaking and crack and the reduction amount in electric resistance value from the initial electric resistance value was smaller than 5%, the power line was determined as acceptable. Also, even after performing the bending 300,000 times at −30° C. and continuously performing the bending 1,200,000 times at room temperature, when there was no external abnormality such as breaking and crack and the reduction amount in electric resistance value from the initial electric resistance value was smaller than 5%, the power line was determined as excellent. The power wires of Examples 1 and 2 were acceptable. In particular, the power wire of Example 1 was excellent. However, the power wire of Comparative Example 1 was unacceptable.

What is claimed is:

1. A multi-core cable for vehicle comprising:

at least one coated electric wire including:

a conductor; and a resin insulating layer configured to cover the conductor, wherein the conductor is configured by stranding a plurality of stranded wires, wherein each of the stranded wires is configured by stranding a plurality of wires, and wherein a diameter of the wires constituting the stranded wire arranged at a center of the conductor is greater than a diameter of the wires constituting the other stranded wires, wherein the multi-core cable further comprises:

a plurality of second electric wires each of which has a second conductor thinner than the conductor and a second insulating layer configured to cover the second conductor, wherein a pair of two second electric wires is twisted and configures a twisted pair of the second electric wires.

2. The multi-core cable for vehicle according to claim 1, wherein the conductor is configured by stranding seven stranded wires, and wherein six of the stranded wires are stranded around one stranded wire arranged at the center of the conductor.

3. The multi-core cable for vehicle according to claim 2, wherein the diameter of the wire constituting one stranded wire arranged at the center of the conductor is equal to or greater than 0.1 mm, and the diameter of the wires constituting the other stranded wires is equal to or smaller than 0.08 mm.

4. The multi-core cable for vehicle according to claim 1, wherein the insulating layer has a copolymer of ethylene and α-olefin having a carbonyl group, as a main component.

5. The multi-core cable for vehicle according to claim 1, wherein an outer diameter of the stranded wire having the greatest outer diameter is 1.5 times or less of an outer diameter of the stranded wire having the smallest outer diameter.

6. The multi-core cable for vehicle according to claim 1, wherein the outer diameter of the stranded wire arranged at the center of the conductor is 75% to 125% of the outer diameter of the other stranded wires.

7. The multi-core cable for vehicle according to claim 1, comprising:

the two coated electric wires; and a sheath configured to cover the two coated electric wires.

8. The multi-core cable for vehicle according to claim 7, wherein a ratio (long axis length divided by short axis length) of a long axis length and a short axis length is 1.8 or greater.

9. The multi-core cable for vehicle according to claim 1, wherein the two coated electric wires and the twisted pair of the second electric wires are stranded, and wherein a sheath covers the two coated electric wires and the twisted pair of the second electric wires.

10. The multi-core cable for vehicle according to claim 9, wherein the two coated electric wires are point-symmetrically arranged on a section perpendicular to a longitudinal direction of the multi-core cable.

* * * * *